US008393928B2

(12) United States Patent
Kumano et al.

(10) Patent No.: US 8,393,928 B2
(45) Date of Patent: Mar. 12, 2013

(54) FIN ATTACHMENT STRUCTURE

(75) Inventors: Katsuyoshi Kumano, Tokyo (JP); Daiki Takahashi, Funabashi (JP)

(73) Assignees: Katsuyoshi Kumano, Tokyo (JP); Michiaki Ishida, Kanagawa (JP); Masahiko Kurata, Kanagawa (JP)

( * ) Notice: Subject to any disclaimer, the term of this patent is extended or adjusted under 35 U.S.C. 154(b) by 189 days.

(21) Appl. No.: 12/376,486

(22) PCT Filed: Jul. 20, 2007

(86) PCT No.: PCT/JP2007/064356

§ 371 (c)(1), (2), (4) Date: Jun. 2, 2010

(87) PCT Pub. No.: WO2009/013793

PCT Pub. Date: Jan. 29, 2009

(65) Prior Publication Data

US 2010/0233921 A1 Sep. 16, 2010

(51) Int. Cl.
*B63B 1/00* (2006.01)
*B63B 35/00* (2006.01)

(52) U.S. Cl. ..... 441/79

(58) Field of Classification Search ..... 441/65, 441/74, 79; 114/278–280, 126, 127, 132, 114/138, 140, 414; 24/645, 509, 538, 594.1, 24/599.7, 664, 614, 662; 403/321
See application file for complete search history.

(56) References Cited

U.S. PATENT DOCUMENTS 5,503,581 A 4/1996 McCullough
6,764,364 B1 * 7/2004 Hickman et al. ..... 441/79
7,264,524 B2 * 9/2007 Batt ..... 441/79
8,096,846 B2 * 1/2012 Posner et al. ..... 441/79

FOREIGN PATENT DOCUMENTS

JP 57-128178 8/1982
JP 58-46972 3/1983
JP 2002-264888 9/2002
JP 2005-508798 4/2005

OTHER PUBLICATIONS

International Search Report for PCT/JP2007/064356 mailed Oct. 16, 2007.

(Continued)

*Primary Examiner* — Daniel Venne
(74) *Attorney, Agent, or Firm* — Nixon & Vanderhye P.C.

(57) ABSTRACT

To provide a fin attachment structure capable of facilitating the attachment/detachment of a fin and also of making the attachment of the fin robust, wherein if the fin comes into contact with human body from behind during surfing, the impact of the fin can be eliminated to restrict the damage to the human body to an extreme minimum and thus safety is improved. The above problem can be solved by a fin attachment structure, in which a groove part in which a fin is attached is provided on the bottom surface of a board and further a pin is provided across the groove parts in the nose direction, plungers are provided at the opposing positions on both side surfaces of the groove in the tail direction, wherein the fin has a hook slot that hooks the fin around the pin at the attachment base portion in the nose direction and a recess portion is provided on the fin side surface corresponding to an projection portion of the plunger when the fin is attached, and thereby, the hook slot of the fin is booked around the pin so that the fin can pivot freely and at the same time, the fin is sandwiched and held by the plungers.

9 Claims, 5 Drawing Sheets

OTHER PUBLICATIONS

Microfilm of the specification and drawings annexed to the request of Japanese Utility Model Application No. 101769/1989 (Laid-open No. 42496/1991), Apr. 22, 1991.

Microfilm of the specification and drawings annexed to the request of Japanese Utility Model Application No. 55470/1972 (Laid-open No. 12697/1974), Feb. 2, 1974.

* cited by examiner

FIN ATTACHMENT STRUCTURE

This application is the U.S. national phase of international Application No. PCT/JP20071064356 filed 20 Jul. 2007 which designated the U.S., the entire content of which is hereby incorporated by reference.

TECHNICAL FIELD

The present invention relates to a fin attachment structure of surfboard and, more specifically, to an attachment structure with which a fin can be detachably attached to the surfboard, wherein the fin readily comes off in an emergency such as when the fin hits against human body.

BACKGROUND ART

Conventionally, there have been roughly two types of fin attachment structure of surfboard: a fixed fin type; and a detachable fin type.

The detachable fin type is used more frequently compared to the fixed fin type and there are various attachment structures because it allows the attachment of a fin in an arbitrary shape according to a user's preference and the fin can be detached and carried.

That is, a fin box etc. is arranged in advance on the bottom surface of a surfboard by embedding it and then the fin is detachably mounted in the fin box.

In this case, structures that allow a fin to be detachable when the fin is broken or carried include those disclosed in Japanese Unexamined Patent Publication (Kokai) No. H6-255575 (patent document 1), Translated Japanese Publication of Patent Application No. 2001-520961 (patent document 2), Translated Japanese Publication of Patent Application No. 2002-530242 (patent document 3), and Japanese Unexamined Patent Publication (Kokai) No. 2003-306195 (patent document 4).

These have a structure in which screws, bolts, etc., are used to fasten a fin for fixing the fin to the fin box.

In addition to the above, structures in which grooves having various structures are provided in the fin box and the fin is fastened by fitting the fin into the groove include those disclosed in Japanese Unexamined Patent Publication (Kokai) No. 2005-74026 (patent document 5), Japanese Unexamined Patent Publication (Kokai) No. 2005-112206 (patent document 6), and Japanese Unexamined Patent Publication (Kokai) No. 2006-280839 (patent document 7).

Further, as a structure in which the fin is fastened using a C-shaped clamp, there is one disclosed in Translated Japanese Publication of Patent Application No. 2003-528003 (patent document 8).

In addition to the above, structures in which the fin is fastened so that it can be attached detachably using a special locking member include those disclosed in Translated Japanese Publication of Patent Application No. 2005-508798 (patent document 9) and Translated Japanese Publication of Patent Application No. 2005-526664 (patent document 10).

Furthermore, as a structure in which both the fin box and the fin fitted therein have a fitting structure in a special shape and thus the fin is fastened detachably, there is one disclosed in Japanese Unexamined Patent Publication (Kokai) No. 2007-160969 (patent document 11).

Patent document 1: Japanese Unexamined Patent Publication No. H6-255575

Patent document 2: Translated Japanese Publication of Patent Application No. 2001-520961

Patent document 3: Translated Japanese Publication of Patent Application No. 2002-530242

Patent document 4: Japanese Unexamined Patent Publication (Kokai) No. 2003-306195

Patent document 5: Japanese Unexamined Patent Publication (Kokai) No. 2005-74026

Patent document 6: Japanese Unexamined Patent Publication (Kokai) No. 2005-112206

Patent document 7: Japanese Unexamined Patent Publication (Kokai) No. 2006-280839

Patent document 8: Translated Japanese Publication of Patent Application No. 2003-528003

Patent document 9: Translated Japanese Publication of Patent Application, No. 2005-508798

Patent document 10: Translated Japanese Publication of Patent Application No. 2005-526664

Patent document 11: Japanese Unexamined Patent Publication (Kokai) No. 2007-160969

DISCLOSURE OF THE INVENTION

As described above, there exist various attachment structures as to surfboard fins.

The structure disclosed in patent document 1 adopts so-called screw fixing and in which a screw is screwed up, or a fin can be detached by unscrewing the screw.

Because of this, attachment and detachment of a fin require a special tool, such as a screwdriver.

Further, when the fin comes into contact with human when it is in use, the fin will remain fastened and human body may be damaged, that is, it is unlikely that the fin comes off the board to prevent the fin from damaging human in such an emergency.

Next, in the structures disclosed in patent document 2, patent document 3, and patent document 4, a fin is screwed up in the transverse direction and detachment of the fin similarly requires a special tool, such as a screwdriver, and even if the surfer falls during surfing and the fin of the surfboard comes into contact with human body, the fin will remain fastened thereto and there is a possibility that the fin may damage human body.

Further, the structures shown in patent document 5 and patent document 6 are those in which a fin is inserted along a groove and fastened to a predetermined position and the fin can be tightly attached, however, is hard to come off.

That is, the structure is not classified as the group of screw fixing but on the other hand, in which the fin is tightly inserted into the groove part in the recess portion in order to prevent the fin from dislodging unnecessarily when in use and fixed in place in the groove.

As a result, it is unlikely that the fin readily comes off the board in a collision etc.

That is, in the configuration shown in patent document 5, the engaging grooves on both the right-hand side and the left-hand side of the fin are inserted into the recess portions of the fin box, and although it is theoretically possible for the fin to move a distance corresponding to the depth of the groove only when it receives an impact toward the conductive portion having the depth of the engaging groove, only the impact in the particularly specified direction is involved and further, the distance of movement is just one corresponding to the depth of the groove.

As a result, it is unlikely that the fin comes off by the impact when the fin hits against human body, and even if the direction of the impact is in one particular direction, the fin moves only a distance corresponding to the depth of the groove and the fin stops at this point, not moving further beyond this point, and therefore, it is not possible to alleviate the impact on the human body.

Further, also in the configuration shown in patent document 6, the lower-rear pin of the fin is inserted into the L-shaped groove of the fin box and at the same time, the upper-front pin is located on the long groove portion.

In this case, at the time of the impact of the fin, as in the above, although it is theoretically possible for the fin to move between the depth of the L-shaped groove and the side of the second planar part having the next L-shaped groove only when it receives the impact in the direction, the distance of movement caused by the impact in the particularly specified direction is only one corresponding to the depth of the groove in a further extremely short width in the same advancing direction.

Consequently, as in the above, it is unlikely that the impact causes the fin to come off when the fin hits against human body and even when the fin hits in one particular direction, the fin moves only an extremely short distance and the fin stops at that position, and therefore, it is not possible to alleviate the impact on the human body.

Next, as to patent document 7, the fin is similarly inserted into the groove and moved along the groove to be attached.

In this case, it is necessary to attach/detach the fin in accordance with the insertion procedure, and in particular, also in the attached state, the fin base portion is pressed down by appropriately providing an interval between the second threaded groove and the recess portion and the fin is fixed by the deformation elastic compression force of the rubber layer provided around the second axis body.

Consequently, the fin is pressed only by narrowing the interval and the pressing force is not so large after the press.

This means that if the fin is tightly inserted by narrowing the interval, the fin becomes more difficult to come off, and therefore, it is not possible for the fin to appropriately come off at the time of impact.

When the interval becomes greater after used repeatedly or when a margin is given, the fin becomes too easy to come off and therefore it is difficult to use it.

Consequently, the adjustment to exhibit an expected effect is extremely difficult and it is not suited for actual use.

Further, for an unexpected impact, it is unlikely that the fin comes off when in use if the fin is so sandwiched in the fin case itself that it can be used securely unless the impact is in one extremely particular direction.

Consequently, when the fin comes into contact with human body, there is a high possibility that the fin remains attached on the board and the human body is damaged.

Next, in the configuration shown in patent document 8, the C-shaped clamp is used to fasten the fin to the fin box as a locking means, that is, the fin is tightly fitted into to be attached to the clamp in the so-called fin box, and a large force is required to detach the fin and at the same time, it is difficult to detach the fin unless the fin is pulled out in one certain direction of the fin box.

Consequently, such an impact caused when the fin comes into contact with human using the surfboard or an impact in a certain direction will not cause the fin to come off and therefore the fin remains fastened thereto.

Further, there arises another need, such as that at least the accuracy at the time of attachment is required, that is, the slot must be matched or the fin must be inserted tightly into the clamp.

According to patent document 9, a cam is rotated by the worm gears and thus the fin is fixed, and therefore, the rotation of the worm gears is necessary to attach/detach the fin and at the same time, the fin is fastened to the board and unlikely to come off by the impact when in use.

Consequently, it is not possible to dislodge the fin in an emergency.

According to patent document 10 also, a tag pin is put into the pin slot and tightened by the club screw, and thus the fin is fastened tightly thereto, however, the fin is unlikely to come off and fall in an emergency.

Further, as to patent document 11, the fin can be attached easily, however, its attaching is done by inserting the fin in the obliquely backward direction and if the screw is not used to fix it, there is a possibility that the fin comes off only when a force is applied in one certain direction in an emergency, but a considerably large force is required to dislodge the fin and only the contact with human body will not dislodge the fin.

Consequently, when the fin comes into contact with human body in variety of unexpected directions, that is, when the fin comes into contact with human body when the surfboard is used, the fin remains in an almost fixed state, and therefore, the contact with human body cannot be dealt with.

As described above, a certain fin attachment structure is desired, which causes the fin to readily come off to prevent damage to human body, that is, which causes the fin to come off the surfboard in a safe manner when in use.

Further, the structure needs to be one capable of preventing the loss of the fin when it comes off.

Furthermore, it is originally required for the fin to be attached tightly to the surfboard without unexpectedly coming off other than in an emergency, such as at the time of contact.

Still furthermore, the attachment structure needs to be one in which the fin can be attached/detached readily for replacement and is fastened securely to the surfboard as shown in the prior art.

The invention of claim 1 according to the present invention is a fin attachment mechanism for detachably attaching a fin to a bottom surface of a surfboard, comprising: a groove part into which a fin attachment base portion is inserted on the bottom surface of the surfboard; a pin provided across the groove parts in a nose direction of the groove part; at least plungers at opposing positions on both side surfaces of the groove part in a tail direction; a hook slot for hooking the pin of the groove part at the attachment base portion of the fin in the nose direction to be inserted into the groove part; and a recess portion corresponding to a projection portion of a ball part on both side surfaces of the fin at which the ball part of the plunger is located when the fin attachment base portion is mounted in the groove part, wherein by the insertion of the fin attachment base portion into the groove part, the hook slot is pivotally hooked around the pin of the groove part so that it can rotate freely and the fin is sandwiched and held within the groove part by the plungers of the groove part, and the problems will be solved by the present invention.

Alternatively, as in the invention according to claim 2, the fin attachment structure may be one having at least two plungers provided at the opposing positions on both side surfaces of the groove part on the side surface of the groove part along the lengthwise direction.

Further, as in the invention according to claim 3, the structure may be one having a hollow part at the opposing positions on both side surfaces of the groove part, wherein the plunger is mounted in the hollow part, or as in the invention according to claim 4, the structure may be one having at least two hollow parts on both side surfaces of the groove of the groove part along the lengthwise direction.

In addition to these, as in the invention according to claim 5, the end portion located in the corner portion of the attachment base portion of the fin to be inserted into the groove part in the nose direction may be configured by the inclined side part, or as in the invention according to claim 6, it may be configured by the arc side part.

Further, as in the invention according to claim 7, the fin attachment structure may be one that sandwiches and holds the fin by the elastic member and the ball part instead of the plunger, or as in the invention according to claim 8, the length of the groove part of the surfboard in the lengthwise direction may be longer than that of the fin attachment base part in the lengthwise direction.

As to the above various configurations, the fin attachment structure may, of course, be used in which the groove part is provided in the fin box and the fin box is mounted to the bottom surface of the surfboard, as in the invention according to claim 9.

From the above configurations, first, the invention according to claim 1 makes it possible to attach the fin so that it can be detachably attached to the surfboard and at the same time, to extremely easily attach/detach the fin without using any tools.

In particular, the fin can be attached tightly by hooking the hook slot on the plunger and the pin and the fin is unlikely to come off unexpectedly.

Further, in the case, which occurs most frequently, where the fin comes into contact with human body from behind during surfing, the fin sandwiched and held by the plunger is dislodged by the impact of the contact of the fin with the human body, the fin is rotated around the pin as its axial center, and the impact of the fin that has hit against the human body is converted into a rotating force and thus the impact on the human body can be cancelled.

Consequently, the damage to the human body by the fin can be cancelled both efficiently and safely.

Further, the hook slot of the fin is hooked around the pin, and therefore, the fin is connected to the board without separating from the board, and thus, there is no possibility of the loss of the fin.

Next, the invention according to claim 2 allows the installation of an arbitrary number of plungers in the opposing directions and thereby the adjustment of the force to sandwich and hold the fin by the plunger.

Consequently, the adjustment of the tight sandwiching and holding of the fin in the normal state and at the same time, the rotation of the fin when receiving the impact can be carried out by the installation of the plunger.

Next, according to the invention according to claim 3, the plunger can be easily installed by providing the hollow part and an attempt can be made to facilitate its manufacture.

Further, according to the invention according to claim 4, many hollow parts can be provided, the plunger can be easily installed in any hollow part, and for example, the adjustment of the installation position of the plunger and the number of plungers to be installed can be made easily.

In addition, the inclined side part of the invention according to claim 5 or the arc side part of the invention according to claim 6 can increase the efficiency of the fin rotation.

Further, according to the invention according to claim 7, the fin can be sandwiched and held by the elastic member and the ball part as can be by the plunger and the fin can be mounted tightly and at the same time, the sandwiching and holding can be cancelled when receiving an impact.

Furthermore, the invention according to claim 8 makes it possible to securely reserve the rotation of the fin and further extend the range of the rotation.

According to the invention according to claim 9, the fin box makes it possible to easily attach the fin to various surfboards and at the same time, the adjustment and modification of the plunger etc. can be made easily and its versatility can be increased.

DESCRIPTION OF THE PREFERRED EMBODIMENT

Figure 1:
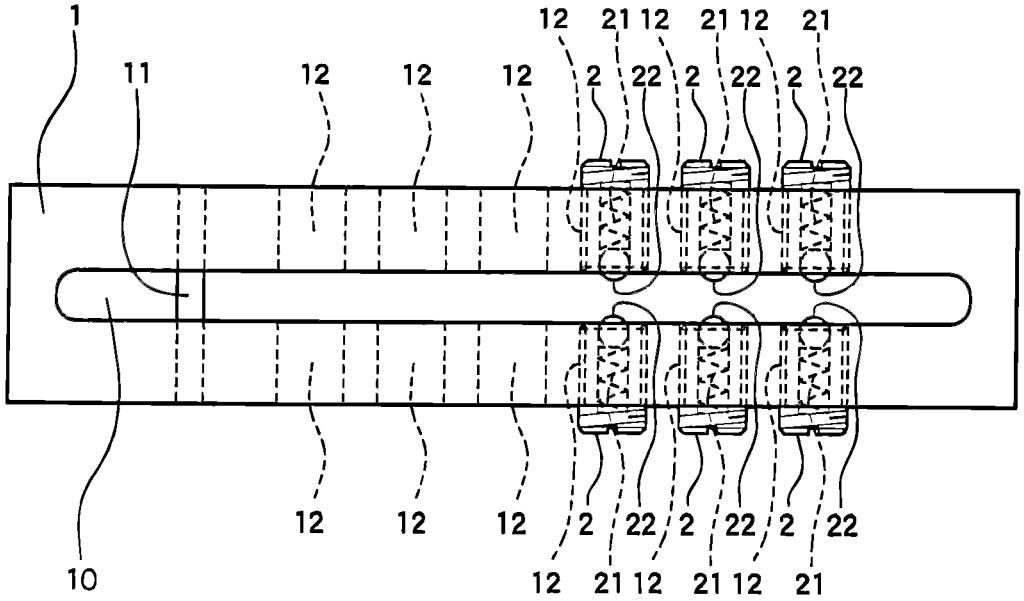
FIG. 1 is a diagram showing an example of a fin attachment part in a fin attachment structure according to the present invention.

FIG. 1 is a diagram showing a basic example of a fin attachment structure according to the present invention, an example of a fin attachment part that is part of the bottom surface of a surfboard.

A fin box 1, which is the fin attachment part of the surfboard, has a groove part 10 for fin attachment, into which an attachment base portion 51 of a fin 5 is inserted.

A pin 11 is provided across the groove part 10 in one direction thereof and on both sides of the inner surface of the groove part 10 in the other direction, a plurality of ball parts 3 biased by a coil spring 2 so as to sandwich both sides of the attachment base portion 51 of the fin 5 to be inserted into the groove part 10 within the groove part 10 is arranged.

The coil spring 2 and the ball part 3 for sandwiching and holding a fin are mounted within a hollow part 12 provided in the inner surface of the groove part 10 as shown in the figure, which has a coil spring 21 at the deep side and a ball part 22 at the opening side.

For example, the plunger 2 is mounted on each portion, respectively, and the ball part 22 is arranged so as to project toward the inside of the groove part 10.

In this case, the ball part is only required to have a projection portion and the coil spring to be an elastic member capable of biasing the ball part with an elastic force.

Consequently, other than those which use the coil spring and the ball part or the plunger, a member capable of sandwiching and holding a fin, not limited to a spherical body having a projection portion, that is, the ball part in the present specification, and an elastic member capable of biasing the ball part, for example, a plate spring or rubber, or rubber materials in various forms, or resin materials having elasticity, or elastic members having a structure to give oil pressure, hydraulic pressure, or air pressure, or elastic members capable of other various kinds of biasing may be used.

Further, three pairs of these are provided on both sides of the groove part 10, respectively, and the fin 5 inserted into the groove part 10 is sandwiched and held from both sides at three portions in total.

That is, the fin is elastically compressed at six portions in total and sandwiched and held from both sides, and therefore, the fin is sandwiched and held at three positions.

Further, the length in the lengthwise direction of the groove part 10 of the surfboard is longer than that of the fin attachment base portion 51 in the lengthwise direction and it is necessary to have a space both in the front direction and in the rear direction of the groove part 10 when the fin 5 is attached.

Next, the fin 5 to be inserted into the groove part 10 has a hook slot 53 at the fin attachment base portion 51 in the nose direction of the surfboard when mounted, that is, in the front direction, and has a spherical recess portion 54 on both sides of the base portion 51 in the rear direction of the fin attachment base portion 51, which corresponds to the projection portion, for example, a spherical surface, of the ball part 22 of the plunger 2.

Consequently, by hooking the hook slot 53 of the fin 5 around the pin 11 within the groove part 10 in a state where the fin attachment base portion 51 in the front direction is inserted into the groove part 10 of the fin box 1, and further by pressing the fin 5 in the rear direction, that is, the fin 5 located in the tail direction of the board in the direction of the groove part 10, the attachment base portion 51 of the fin 5 in the rear direction is inserted into the groove part 10.

Further, at the fin attachment base portion 51 in the rear direction, the ball part 22 of the plunger 2 located on both inner sides of the groove part 10 comes into its inside against the elastic member within the plunger 2, for example, the spring part 21, and thus the fin base portion 51 is inserted eventually.

In this case, the ball part 22 of the plunger 2 is inserted into the recess portion 54 provided on both sides of the fin attachment base portion 51 and is anchored and mounted tightly in place at that position.

In the figure, description is given premised on the fin box 1, however, those having respective configurations of the groove part 10, the pin 11, and the plunger 2 directly on the bottom surface of the surfboard may, of course, be accepted.

In the case where the fin attachment base portion 51 is inserted into the groove part 10 for fin on the bottom surface of the surfboard with the configuration described above, the fin is attached on the board of the fin attachment base portion 51 in the front direction so that it can rotate freely due to the hook slot 53 and the pin 11, and in the rear direction, the fin 5 is sandwiched and held by the plunger 2 from both side surfaces at three portions on one side, respectively, in the figure and thus the fin 5 is mounted on the surfboard.

Further, with such a configuration, besides that the fin can be attached on the board tightly and detachably, when a force is applied unexpectedly to the fin 5 from behind, the fin attachment base portion 51 comes off the recess portion 54 of the fin against the elastic compression force of the plunger 2 and the rear of the base portion 51 of the fin comes off the groove part 10, however, the fin 5 remains in the state where it is attached to the board due to the hook slot 53 hooked around the pin 11.

That is, although the rear of the fin comes off the plunger 2 and is pulled out to outside from the groove part 10, the hook slot 53 on front of the fin 5 is still hooked around the pin 1, and therefore, the fin 5 is caught by the board in a state of having rotated in the forward direction.

Because of this, in particular, the sandwiched and held state by the plunger 22 having the ball part 22 biased by the spring 21 etc. can be released in a state where the rear of the fin 5 is in contact with human body from, which occurs much frequently, that is, in a state where a force from the rear of the fin 5 is applied, and therefore, the force from the rear of the fin 5 can be converted into a rotational force with the pin 11 of the hook slot 53 of the fin as its axial center and the fin 5 can be dislodged from the fixed position in the groove part 10.

Consequently, even if the fin 5 hits against the human body, the fin 5 comes off and rotates along a large locus, and thus the contact state with the human body can be avoided and the impact can be released without the damage to the human body.

The fin box 1 in the figure further has the three hollow parts 12 to which the plunger 2 can be mounted on each of both sides, respectively.

In the figure, three on each side, however, the number of mounting portions is arbitrarily and it is only required for the plunger 2 to be provided at arbitrary portions of the hollow part on both sides.

It is only required for an arbitrary number of plungers 2 to be arranged at arbitrary portions accordance with the elastic compression force of the plunger 2, that is, the magnitude of the biasing force applied to the ball part 22 and the adjustment performance.

As shown in the figure, a configuration may be one, in which the inner circumferential surface of the hollow part 12 is caused to have a spiral shape and the outer circumferential surface of the plunger 2 is also caused to have a spiral shape, and thereby the hollow part 12 and the plunger 2 are screwed into each other.

Further, it may also be possible to adjust the biasing force, which is an elastic compression force, by adjusting the screwed state.

Figure 2:
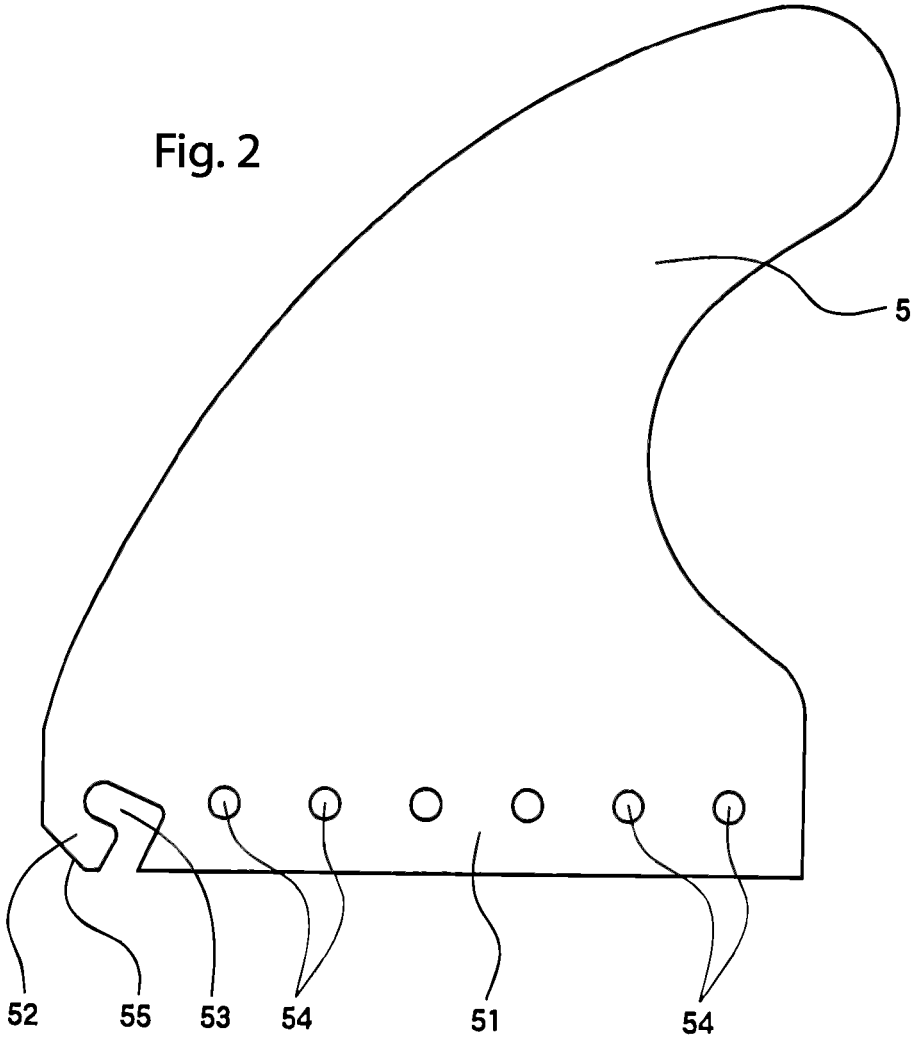
FIG. 2 is a diagram showing an example of a fin in a fin attachment structure according to the present invention.

FIG. 2 is a diagram showing an example of a fin to be mounted into the groove part 10 of the surfboard in FIG. 1.

As shown in the figure, the fin 5 has the hook slot 53 in the front direction of the fin attachment base portion and the many recess portions 54 having a shape corresponding to the projection portion of the ball part 22 of the plunger 2, for example, a spherical surface, are provided successively on both sides of the fin attachment base portion 51 in the rear direction.

The recess portion 54 may be provided as the need arises and the figure only shows an example, and a configuration may be accepted, in which, for example, an arbitrary number of the recess portions 54 are provided on one side, or in which the recess portions 54 are provided at arbitrary portions.

It is optimum to have the recess portion 54 at a position at least corresponding to the plunger 2 that sandwiches and holds the fin from both sides, and in this case, the sandwiching and holing effect can be magnified most, however, the recess portion may, of course, be omitted.

In this case, an end portion 53 corresponding to the corner portion of the fin attachment base part in the front direction of the fin attachment base portion 51, that is, at the front of the hook slot 53, is configured by an inclined side part 55.

In this manner, by configuring the end portion 52 of the attachment base portion 51 by the inclined side part 55, not by the corner portion, the fin 5 can be easily caused to fall down in the forward direction and can be rotated around the pin 11 due to the hook slot 53 with the pin 11 as its axial center.

In the figure, the inclined side part 55 is used in the configuration, however, instead of this, an arc side part may be used in the configuration.

Figure 3:
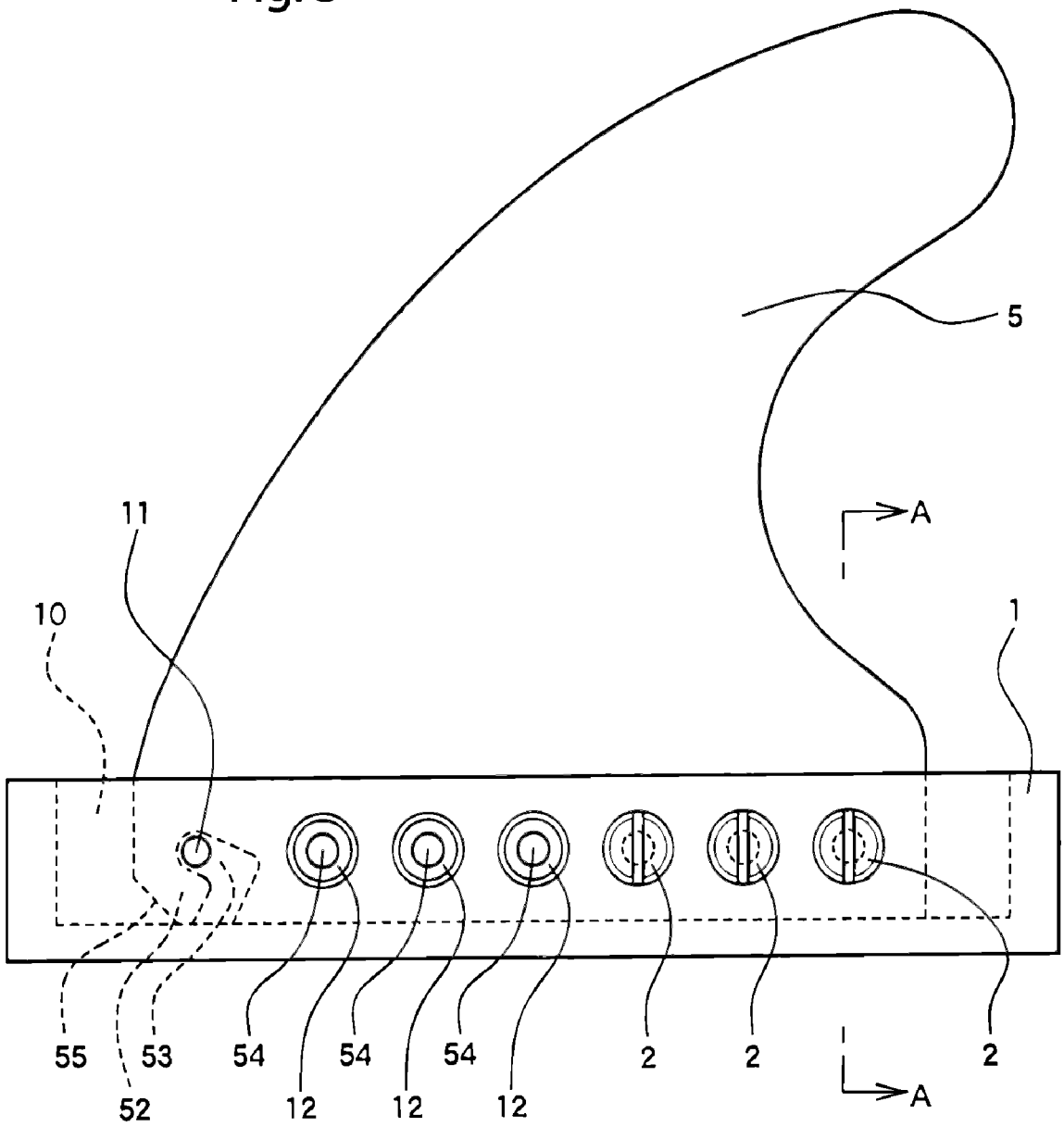
FIG. 3 is a diagram showing an example of a fin in a fin attachment structure according to the present invention.

FIG. 3 is a diagram showing an example of a state where the fin 5 is mounted in the fin box 1 in FIG. 1.

As shown in the figure, in the front direction of the fin attachment base portion 51, the pin 11 within the groove part 10 of the box 1 is hooked on the hook slot 53 and in the rear direction, the fin is sandwiched and held, and thus fastened thereto by the plungers 2 comprising the ball part 22 biased by the spring 21 at the three portions on the side surface portion.

That is, although not shown schematically, the plunger 2 is provided similarly at the position at which the fin 5 is sandwiched and held thereby together with the plunger 2 in the figure on the inner surface of the groove part 10 on the opposite side.

In this case, the fin box 1 has the six hollow parts 12 in total on the side surface and among these, the plunger 2 is arranged in three hollow parts 12 at the rear part of the fin.

In particular, the sandwiching and holding force is stronger at the rear part of the fin, and therefore, with this being taken into consideration, the plunger 2 may be arranged at arbitrary positions.

In this case, the end portion 52 in the front direction of the fin attachment base portion 51 is configured by the inclined side part 55.

In addition to the configuration in which the plunger 2 is provided in the fin box 1, a configuration in which the groove part 10 is provided directly on the surfboard and the plunger 2 is provided on both side faces of the inner side, or a configuration in which the hollow part 12 is provided, or a configuration in which the groove part 10 is formed directly on the main body of the board and the plunger 2 is further arranged in the groove part 10, or a configuration in which the fin box 1 does not have the many hollow parts 12 in advance but the plunger is embedded directly may be accepted.

The length in the lengthwise direction of the groove part 10 of the surfboard is configured so as to be longer than that in the lengthwise direction of the fin attachment base portion 51 and an example is shown, in which there is provided a space in the front direction and in the rear direction of the groove part 10, respectively, when the fin 5 is attached, however, the interval of the space is not limited and a longer space may be provided.

Figure 4:
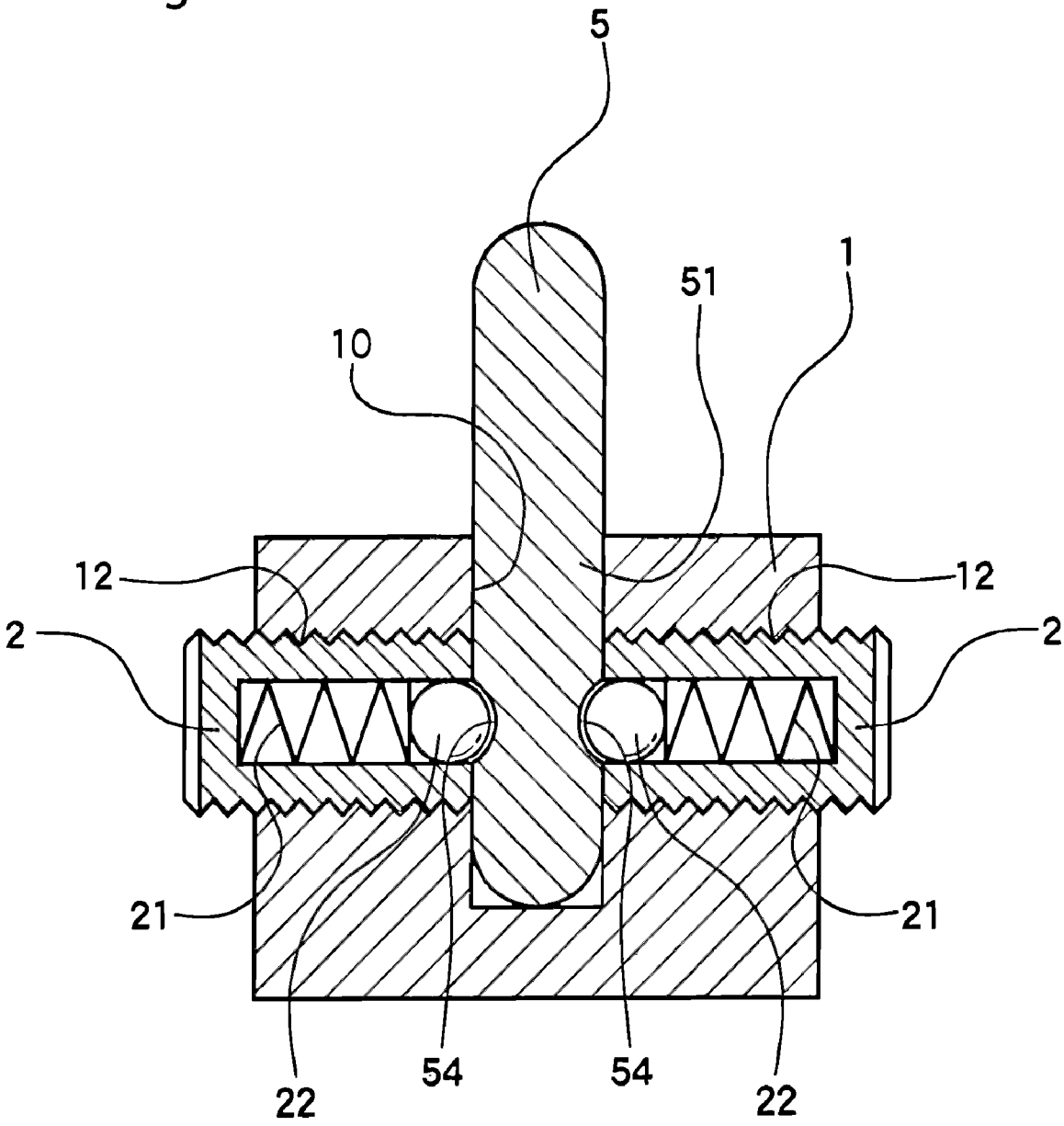
FIG. 4 is a cross-sectional view along A-A line in FIG. 3.

FIG. 4 shows a cross-sectional view along A-A line in FIG. 3.

As shown in the figure, the hollow parts 12 are provided respectively at the opposing positions on both sides of the inner surface of the groove part 10 of the beard and the plunger 2 is provided in the hollow part 12, and thereby both sides of the fin attachment base portion 51 inserted into the groove part 10 are sandwiched and held.

In this case, the recess portion 54 is provided at the corresponding portion of the fin 5 and thus the ball part 22 of the plunger 2 is tightly fitted into to be attached.

The shape of the hollow part 12 shows only an example and the shape is not limited to this.

The plunger 2 is explicitly shown, however, this is not limited and, for example, the plunger 2 may be one that has the coil spring 21 and the ball part 22 biased by the coil spring 21 in the hollow part 12, or one that has, instead of the coil spring, the elastic member 21 that can bias in the direction toward the inside of the groove part, such as a resin material or rubber that has elasticity, or a plate spring, or a spring member in another form, and which has an elastic compressing force capable of at least fixing the fin.

Alternatively, the elastic member 21 having a structure that gives oil pressure, hydraulic pressure, or air pressure may be accepted.

The ball part 22 is only required that at least its contact surface with the fin 5 be formed into the shape of a projection portion and its shape is not limited to a spherical body.

Consequently, it is only required to have at least a projection portion.

Figure 5:
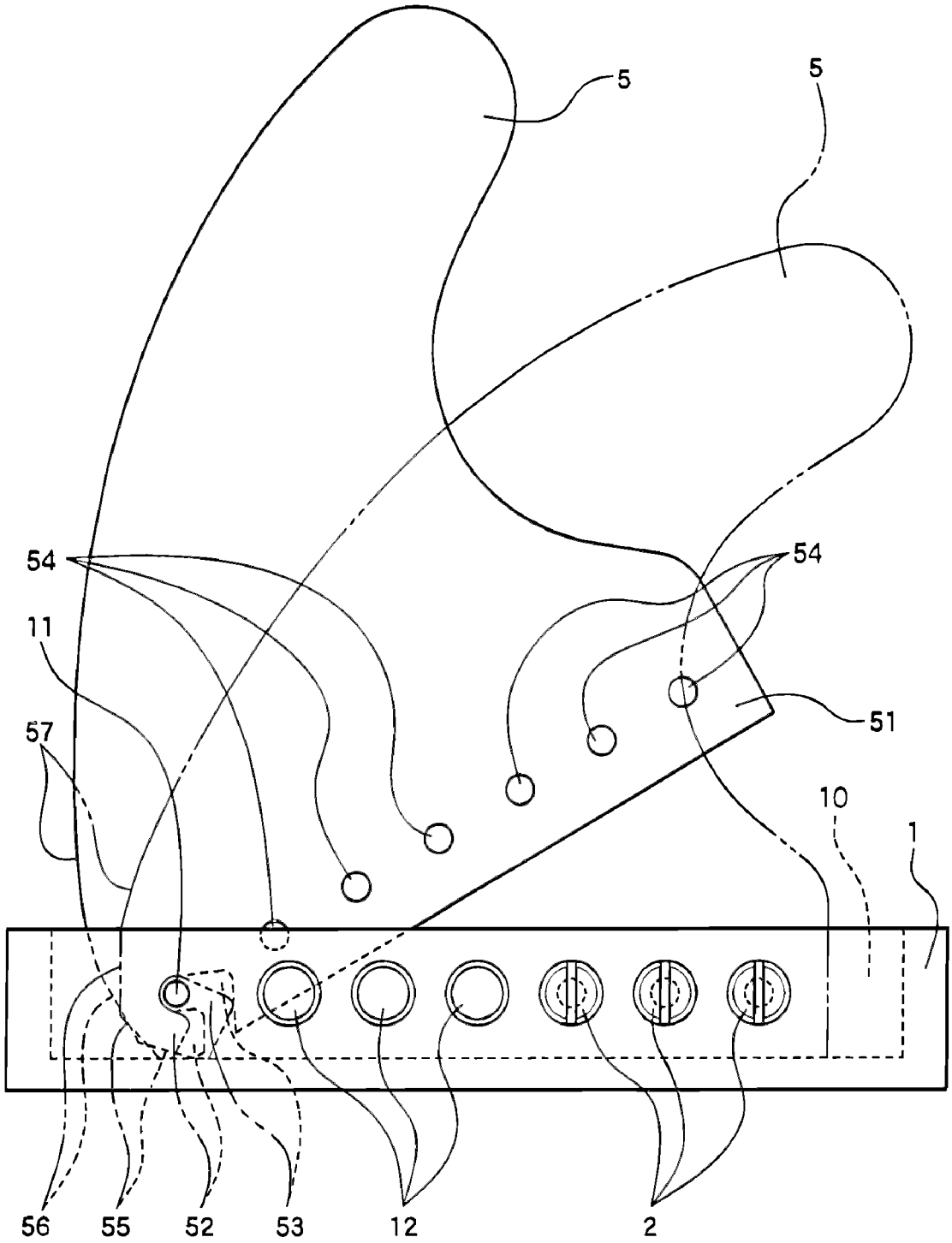
FIG. 5 is a diagram showing an example of the rotation state of a fin in a fin attachment structure according to the present invention.

FIG. 5 explicitly shows an example of the fin 5 by the solid line in the state where a force due to contact etc. is applied from the rear of the fin 5 and the fin 5 sandwiched and held in the rear direction comes off the surfboard from the state where the fin 5 expressed by the alternate long and two short dashes line is mounted on the surfboard.

As shown in the figure, by the dislodgment of the sandwiched and held fin 5, the impact by the fin 5 can be reduced and, for example, when it comes into contact with human body, it is possible to avoid the damage to the human body or restrict the damage to a minimum.

Further, the impact can be avoided in this manner, and therefore, the damage to the fin 5 itself can also be restricted to a minimum.

In particular, the corner portion, that is, the end portion 52 in the front direction of the fin attachment base portion 51 is configured by the inclined side part 55, and therefore, the rotation of the attachment base portion 51 of the fin 5 with the hook slot 53 of the fin 5 as its axial center is facilitated within the groove part 10.

Further, only part of the sandwiched and held fin is dislodged, and the fin 5 is still caught by the pin 11 within the groove part 10, and therefore, it is possible to prevent the loss of the fin 5.

Each of the cases may be accepted, where the state of rotation shown in the figure, that is, the rotation is controlled by the inclined side part 55 hitting against the bottom part of the groove part 10, or where the rotation is controlled by the bottom part of the groove part 10 coming into contact due to a front side part 56 of the fin attachment base portion 51 beyond the inclined side part 55, or where the rotation is controlled by a front inclined side part 57 of the fin coming into contact with the bottom part of the groove part 10 without both the inclined side part 55 and the side part 56 coming into contact with the bottom part, or where the rotation can be continued until the further rotation is controlled by the contact with the opening end side part of the groove part 10 of the fin box 1.

The figure is a diagram showing an example of the state of rotation.

The state is shown where a force is applied from the rear of the fin and the fin sandwiched and held by the plunger comes off from the state where the fin is sandwiched and held by the plunger 2 comprising the ball part 22 biased by the spring 21 at three portions in total at the side surface part in the rear direction of the fin.

Figure 6:
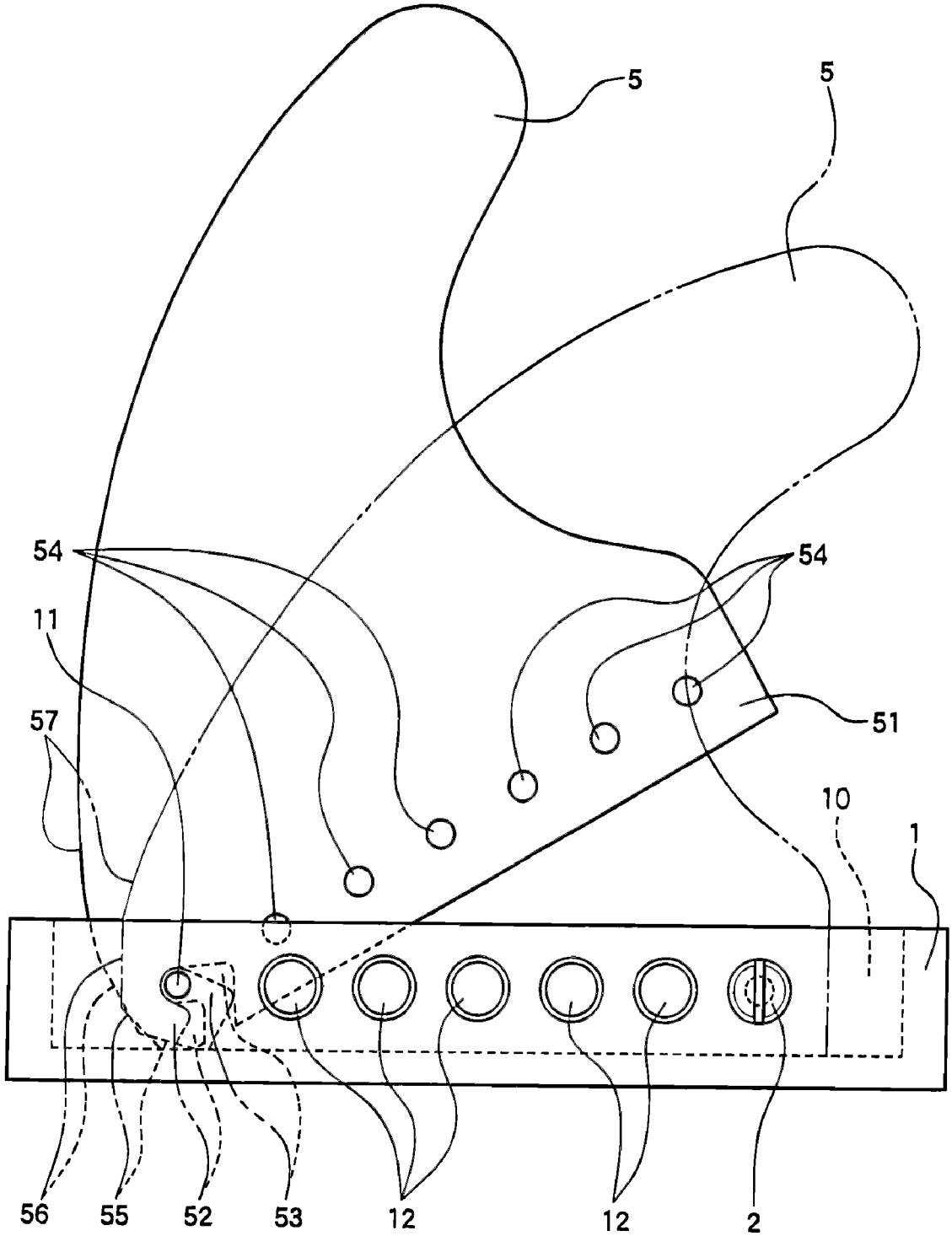
FIG. 6 is a diagram showing another example of the rotation state of a fin in a fin attachment structure according to the present invention.

FIG. 6 shows an example, in which the fin box 1 has the fin attachment mechanism according to the present invention, showing an example of the fin attachment structure in which the plunger 2 is provided at one portion, respectively, on one side of the groove part 10 of the fin box 1

A configuration in which the fin 5 is sandwiched and held by the plunger from both sides of the groove part 10 at one portion as shown in the figure may also be accented.

A configuration in which the fin is sandwiched and held from both ends with the plunger 2 provided at many portions to increase the sandwiching and holding force, that is, two portions, or three or more portions, respectively, on one side may also, of course, be accepted.

| | |
|---|---|
| 1 | fin box |
| 10 | groove part |
| 11 | pin |
| 12 | hollow part |
| 2 | plunger |
| 21 | elastic member |
| 22 | ball part |
| 5 | fin |
| 51 | attachment base portion |
| 52 | end portion |
| 53 | hook slot |
| 54 | recess portion |

-continued

| | |
|---|---|
| 55 | inclined side part |
| 56 | front side part |
| 57 | front inclined side part |

The invention claimed is:

1. A fin attachment structure for detachably attaching a fin to a bottom surface of a surfboard, the fin attachment structure comprising:

a fin which includes a fin attachment base for attaching the fin to the bottom surface of the surfboard, wherein the fin attachment base includes fin nose and tail portions, and opposed side surfaces;

a groove part having groove nose and tail portions formed on the bottom surface of the surfboard, wherein the groove part receives the fin attachment base portion when inserted therein;

a pin provided across the groove nose portion of the groove part;

at least one pair of opposed plungers located at both respective side surfaces of the groove part at the groove tail portion, wherein each of the plungers includes a ball part having a projection portion which projects outwardly therefrom;

a hook slot formed in the attachment base portion of the fin for hooked engagement with the pin at the groove nose portion when the fin attachment base portion is inserted into the groove part; and recess portions formed on both of the side surfaces of the fin attachment base portion in positional correspondence to the projection portion of the ball part of a respective one of the plungers, wherein each of the recess portions receive the ball part of a respective one of the plungers when the fin attachment base portion is inserted into the groove part, wherein the hook slot is pivotally hooked around the pin at the groove nose portion of the groove part upon insertion of the fin attachment base portion into the groove part so that the fin attachment base portion is capable of freely rotating about the pin to thereby allow the fin to be sandwiched and held within the groove part by the plungers.

2. The fin attachment structure according to claim 1, wherein the groove part includes opposed side surfaces, and wherein the fin attachment structure comprises multiple pairs of the plungers arranged on the side surfaces of the groove part and separated from one another along a lengthwise direction thereof.

3. The fin attachment structure according to claim 1, wherein the groove part includes opposed side surfaces, and positionally opposed hollow parts provided on both of the side surfaces of the groove part, wherein the plungers are mounted in a respective one of the hollow parts.

4. The fin attachment structure according to claim 3, which comprises multiple hollow parts provided at least at two positions along a lengthwise direction of the groove part on both of the side surfaces thereof.

5. The fin attachment structure according to claim 1, wherein the attachment base portion includes an inclined end portion located at a corner portion of the fin nose portion.

6. The fin attachment structure according to claim 1, wherein the attachment base portion includes an arcuate end portion located at a corner portion of the fin nose portion.

7. The fin attachment structure according to claim 1, wherein the plungers comprise an elastic member for biasing the ball part into engagement with a respective one of the recess portions.

8. The fin attachment structure according to claim 1, wherein groove part has a length in a lengthwise direction of the surfboard that is longer than a length of the fin attachment base portion.

9. The fin attachment structure according to claim 1, which comprises a fin box mounted on the bottom surface of the surfboard, wherein the fin box comprises the groove part.

* * * * *